United States Patent [19]

Simich

[11] 4,342,138

[45] Aug. 3, 1982

[54] OVAL BALE-TIE WIRE AND PROCESS OF MAKING THEREOF

[75] Inventor: Emil Simich, Chicago, Ill.

[73] Assignee: A. J. Gerrard & Company, Des Plaines, Ill.

[21] Appl. No.: 71,680

[22] Filed: Aug. 31, 1979

[51] Int. Cl.[3] ..... B65D 63/02

[52] U.S. Cl. ..... 24/27; 24/20 EE; 24/20 W

[58] Field of Search ..... 24/27, 20 EE, 20 W, 24/28, 29

[56] References Cited

U.S. PATENT DOCUMENTS

| | | | |
|---|---|---|---|
| 1,479,431 | 1/1924 | Gerrard et al. | 24/27 |
| 2,356,936 | 8/1944 | Krause | 24/27 |
| 3,023,037 | 2/1962 | Sandor | 24/27 |
| 3,168,912 | 2/1965 | Marica | 24/27 |
| 3,949,450 | 4/1976 | Bailey | 24/27 |
| 4,070,733 | 1/1978 | Simich | 24/27 |

FOREIGN PATENT DOCUMENTS

| | | | |
|---|---|---|---|
| 348644 | 5/1937 | Italy | 24/27 |
| 441865 | 1/1936 | United Kingdom | 24/27 |

*Primary Examiner*—Victor N. Sakran

*Attorney, Agent, or Firm*—Emrich, Lee, Brown & Hill

[57] ABSTRACT

An ovalized cross-sectional shaped bale-tie wire for use in baling materials includes a body portion and engaging looped members formed at each end of the body portion. The process for manufacturing an ovalized cross-sectional shaped bale-tie wire includes the steps of withdrawing round wire from a wire drum, straightening the round wire, passing the straightened wire through an ovalizing mill to form the ovalized cross-sectional shaped wire, accumulating the ovalized cross-sectional shaped wire, controlling the length of the wire by predeterminely cutting the wire preforming simultaneously the engaging looped members on the trailing end of the leading bale-tie wire and the leading end of the trailing bale-tie wire and bending the looped end portions out of the plane of the body portion of the bale-tie wire.

2 Claims, 15 Drawing Figures

FIG. 10
OVAL WIRE BALE-TYS KNOT STRENGTH
10 GAGE WIRE
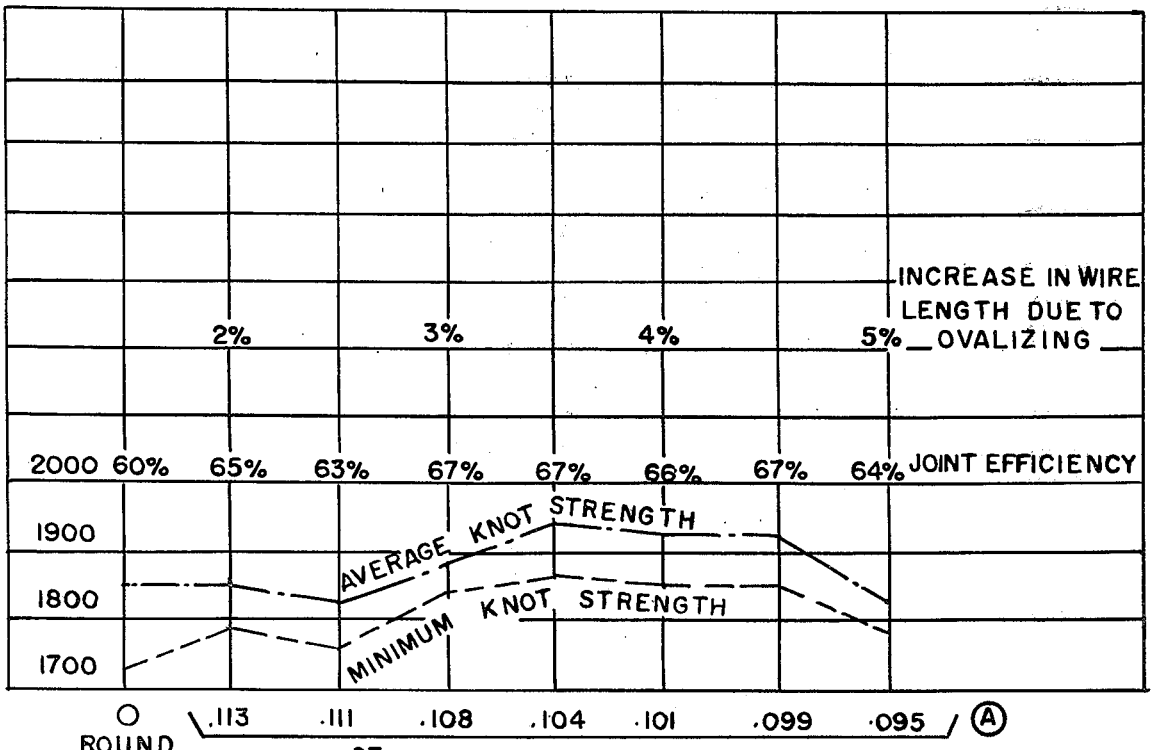
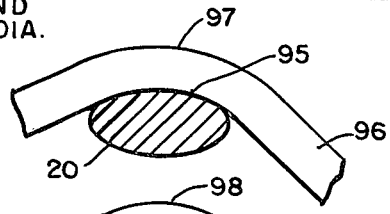
FIG. 12
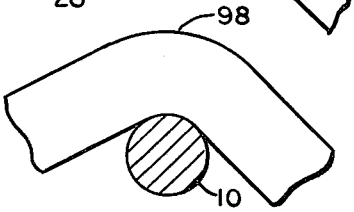
FIG. 13
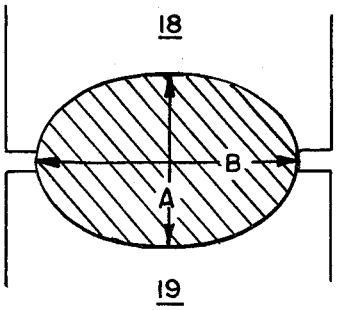
FIG. 11

OVAL BALE-TIE WIRE AND PROCESS OF MAKING THEREOF

BACKGROUND OF THE INVENTION

In the past bale-tie wires have almost universally been comprised of a round steel wire of predetermined length having looped end engaging members formed thereon. Generally, the round shaped bale-tie wires are manufactured in two separate steps. The first being the straightening and cutting the length of the round steel wire and the second step is the feeding of the round wires into an end forming machine to form the looped end members. The problems of feeding the round steel wire and proper placement between closely spaced machine forming parts have resulted in rejected bale-tie wires and down-time in the two step process of forming round steel bale-tie wires.

Additionally, it has been determined, see for example U.S. Pat. No. 3,949,450, that because fracture or breakage of round bale-tie wires occurs first in the thief knot portion of the wire, rather than in the central body portion of the wire, it is possible to make the body portion of the wire somewhat oval in shape to reduce the strength of the body portion to more closely approximate the strength of the knot. This provided thereby in economic savings because less wire was required to make a given length of tie wire than was required in conventional round tie wire. However, such teaching further determined that oval shaping of the looped end members resulted in a substantial reduction in knot strength, thereby resulting in unacceptable bale-tie wires.

In U.S. Patent application Ser. No. 446,710, assigned to the assignee of the present invention and now abandoned, bale-tie wires of generally oblong or oval in cross-section with flattened sides have been described to prevent interlacing of the bale-tie wires during storage and shipment and to provide a bale-tie wire wherein the preformed ends are self-aligning. However, such bale-tie wires prepared by flattening the round bale-tie wire between a pair of rolls produced flash which substantially reduced the wire strength of the bale-tie wire and produced edges which interfered and endangered the user of the bale-tie wire during the application around the bale. Consequently, such oblong shaped bale-tie wires having flattened edges were unacceptable to baling press applications.

SUMMARY OF THE INVENTION

One object of the present invention is to provide an ovalized cross-sectional shaped bale-tie wire having a body portion and engaging looped members formed at each end of the body portion for use in baling materials.

Another object of the present invention is to provide an ovalized cross-sectional shaped bale-tie wire joint possessing increased joint efficiency of the thief knot portion than is obtainable from conventional round bale-tie wires.

Still another object of the present invention is to provide an ovalized cross-sectional shaped bale-tie wire possessing increased wire strength and joint efficiency that is obtainable from conventional round bale-tie wire material.

It is still a further object of the present invention to provide a continuous process for making ovalized cross-sectional shaped bale-tie wires having a body portion and engaging looped members formed at each end of the body portion.

The ovalized cross-sectional shaped bale-tie wire of the present invention provides a tie wire having a body portion and engaging loop members formed at each end of the body portion with rearwardly extending legs thereon to provide a thief knot. The looped end portions are bent out of a flat plane such that when the wires are assembled together around the girth of the bale they form a thief knot. Unexpectedly the ovalized cross-sectional shaped wire provides a joint efficiency of the thief knot which is substantially greater than the standard round diameter bale-tie wire. The oval wire increases the joint strength of the thief knot because the looped alignment resulting from the engaging looped members permits the wire to bend about the major axis of the cross-sectional area with reduced tensile stresses at the outer fibers of the wire, thereby increasing the joint efficiency of the thief knot. Additionally, the ovalized cross-sectional shaped bale-tie wire presents a substantially flat surface against the outer surface of the baled material so as not to damage or cut into the bale and provides a bale-tie wire which requires less metal for a given wire length than conventional round shaped bale-tie wires.

The process for manufacturing an ovalized cross sectional shaped bale-tie wire includes the steps of withdrawing round cross-sectional wire from a wire drum and passing the round wire through a straightening apparatus to straighten the round wire. The straightened round wire is then passed through an ovalizing mill to form the ovalized cross-sectional shaped wire which is then accumulated about an accumulator. Then, the ovalized bale-tie wire is cut to a predetermined length and then engaging looped members are preformed simultaneously on the trailing end of the leading bale-tie wire and the leading end of the trailing bale-tie wire by bending the looped end portion out of the plane of the body portion of the bale-tie wire. Additionally, a crimper device may be provided to selectively crimp the wire in predetermined locations to permit bending the wire about the baled material and to predeterminedly locate the wire about the baled material to permit alignment of the looped ends for engagement.

DESCRIPTION OF THE DRAWINGS

FIG. 10 is a table summarizing the wire strength, knot strength and joint efficiency of ovalized bale-tie wire in comparision with conventional round bale-tie wire;

FIG. 11 is a cross-sectional view taken through the ovalizing mill illustrating the process for making ovalized cross-sectional shaped bale-tie wire in accordance with the present invention;

FIG. 12 is an enlarged perspective view showing the looped alignment resulting from the looped end member bending about the major axis of the cross-sectional area of the ovalized bale-tie wire in accordance with the present invention;

FIG. 13 shows the looped alignment resulting from the looped member bending about the major axis of a conventional round bale-tie wire;

DETAILED DESCRIPTION

Figures 1, 2, 3, 4:
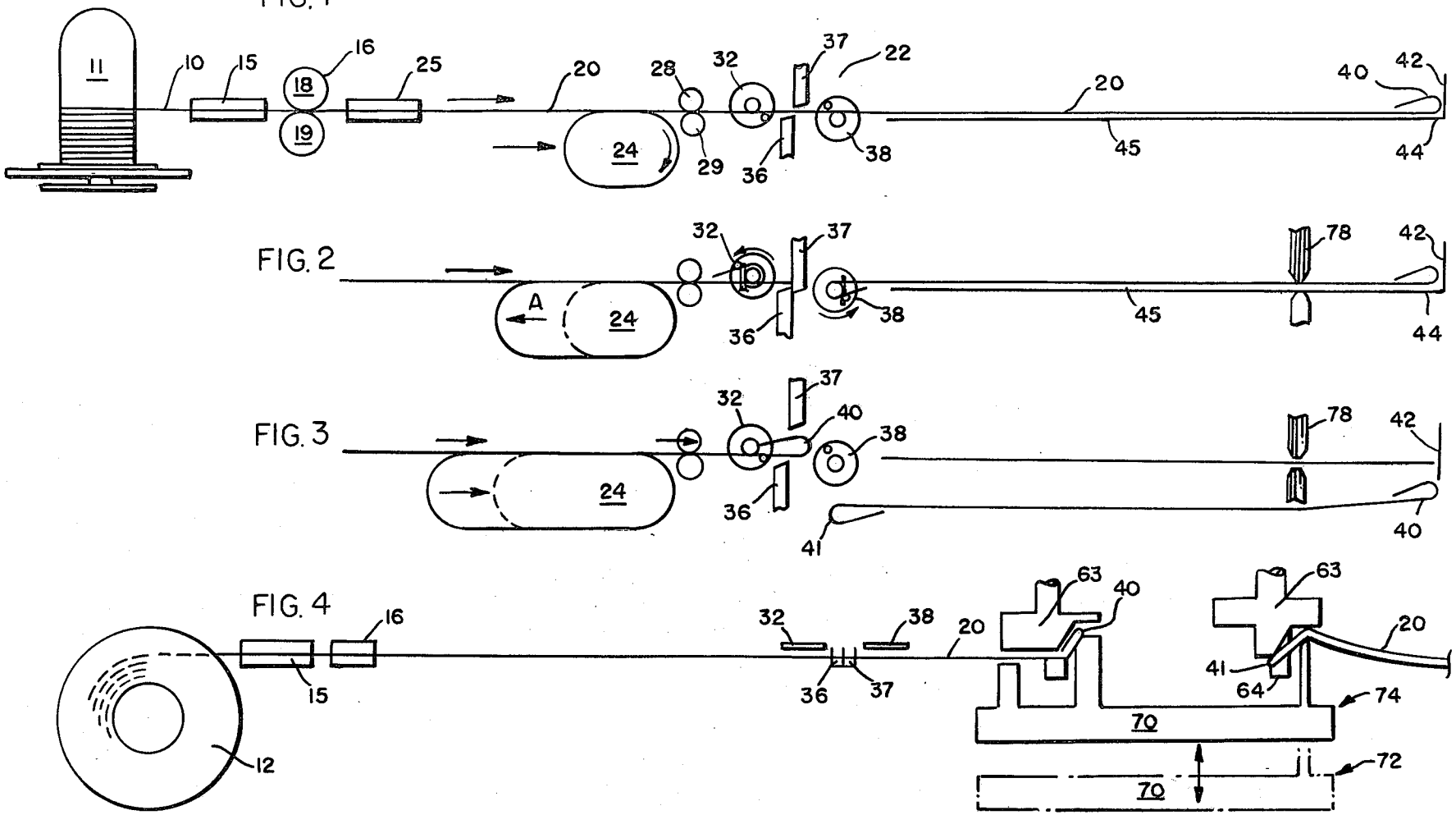
FIG. 1 is a side elevational view of the process for making an ovalized bale-tie wire in accordance with the present invention.
FIG. 2 is a partial side elevational view of the process for making an ovalized bale-tie wire schematically illustrating the cutting of the bale-tie wire in predetermined lengths and the engaging looped members being preformed simultaneously on the trailing end of the leading bale-tie wire and the leading end of the trailing end of the bale-tie wire in accordance with the present invention.
FIG. 3 is a partial side elevational view of the process for making ovalized bale-tie wire showing the ejection of a finished ovalized cross-sectional shaped bale-tie wire and the feeding of the next bale-tie wire into the machine for subsequent cutting to predetermined lengths and preforming of the trailing and leading edges of the wire in accordance with the present invention.
FIG. 4 is a top plan view of the process for making an ovalized cross-sectional shaped bale-tie schematically illustrating the path of travel of the bale-tie wire and the engagement of the former with the pair of rotatable anvils to preform the engaging looped members at each end of the bale-tie wire out of the plane of the body portion of the ovalized bale-tie wire in accordance with the present invention.

Referring now to the drawings, wherein like reference numerals have been used throughout the several views to identify the same or similar parts, FIG. 1 depicts schematically, the process for making ovalized cross-sectional bale-tie wires from a conventional round wire, in which a supply of round wire 10, which is supported by a stump 11 mounted on a free standing rotatable holder 12. A conventional wire straightener 15 is positioned between the stump 11 and the ovalizing mill assembly 16, which is comprised of an upper and lower grooved rolls 18 and 19 which are driven at a constant rate of speed. The upper and lower groove rolls 18 and 19 compress the round wire 10 and pull the wire from the stump 11 to produce a cold formed ovalized cross-sectional bale-tie wire 20, as shown in FIG. 11. In addition to cold forming the ovalized cross-sectional bale-tie wire, the ovalizing mill assembly 16 provides a positive drive means for advancing the wire along the bale-tie wire assembly or machine 22 thereby eliminating slippage between the drive rolls 18 and 19 simultaneously straightening the oval cross-sectional bale-tie wire that is then directed into the accumulator assembly 24. However, if necessary, it is possible to position and feed the oval bale-tie wire 20 through an additional wire straightener assembly 25 to insure the proper orientation and position of the ovalized bale-tie 20 as it is fed through and around the accumulator assembly 24.

The oval shaped bale-tie wire 20 is then engaged by a pair of feed wheels 28 and 29 which engage the wire and push the wire between the first anvil assembly 32, past the cutter assembly 35 and between a second anvil assembly 38 until the leading end 40 of the bale-tie wire engages a limit stop switch 42. The limit stop switch 42 is predeterminedly positioned from the cutter assembly 35 to control the length of the bale-tie wire 20, as desired. Preferably, the bale-tie wire advances to the limit switch through a channel member 44 having a trapped door 45 thereon which is operatively opened to permit the completed bale-tie wire to drop out of the channel member onto a conveyor member for subsequent boxing or usage, as will hereinafter be discussed.

When the leading end 40 of the bale-tie wire 20 engages the limit stop switch 42, the feed rolls 28 and 29, mounted to a slip clutch assembly (not shown), are permitted to slip and stop turning thereby. Thereupon the cutter assembly 35, comprised of a lower stationary cutter bar 36, and an upper movable cutter bar 37 is actuated such that the upper movable cutter bar moves downwardly to cut the bale-tie wire 20 to predeterminedly control the length of the wire.

Figure 5:
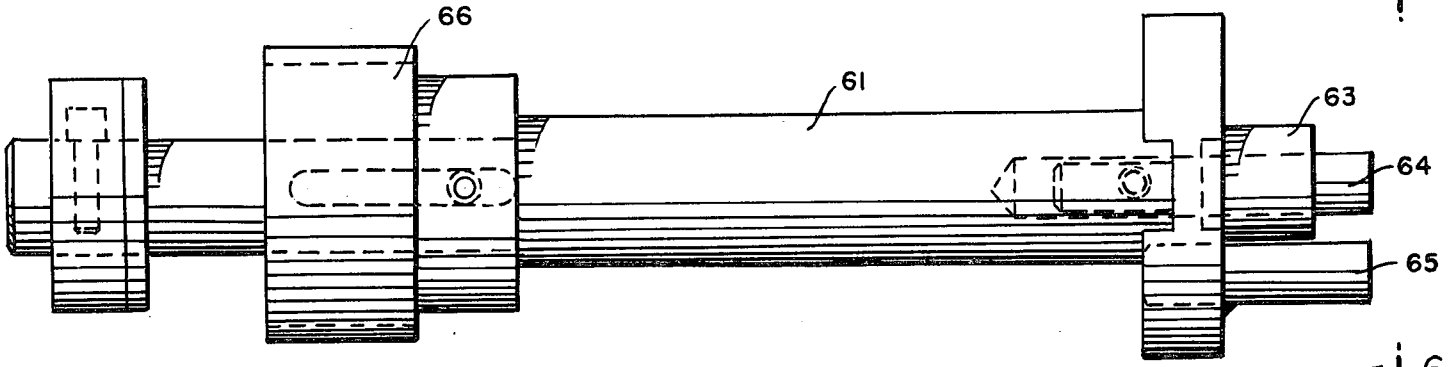
FIG. 5 is the side elevational view of the anvil and turntable assembly for preforming the engaging looped members on the bale-tie wire in accordance with the present invention.
Figure 6:
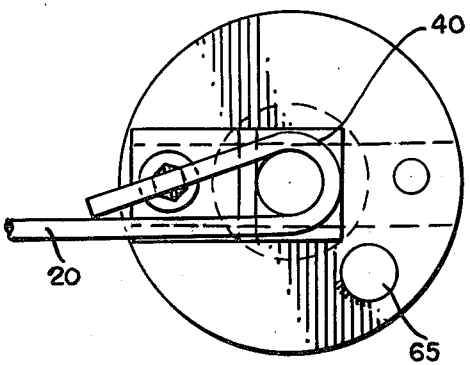
FIG. 6 is an end view of the anvil and turntable assembly taken along line 6—6 of FIG. 5.
Figure 15:
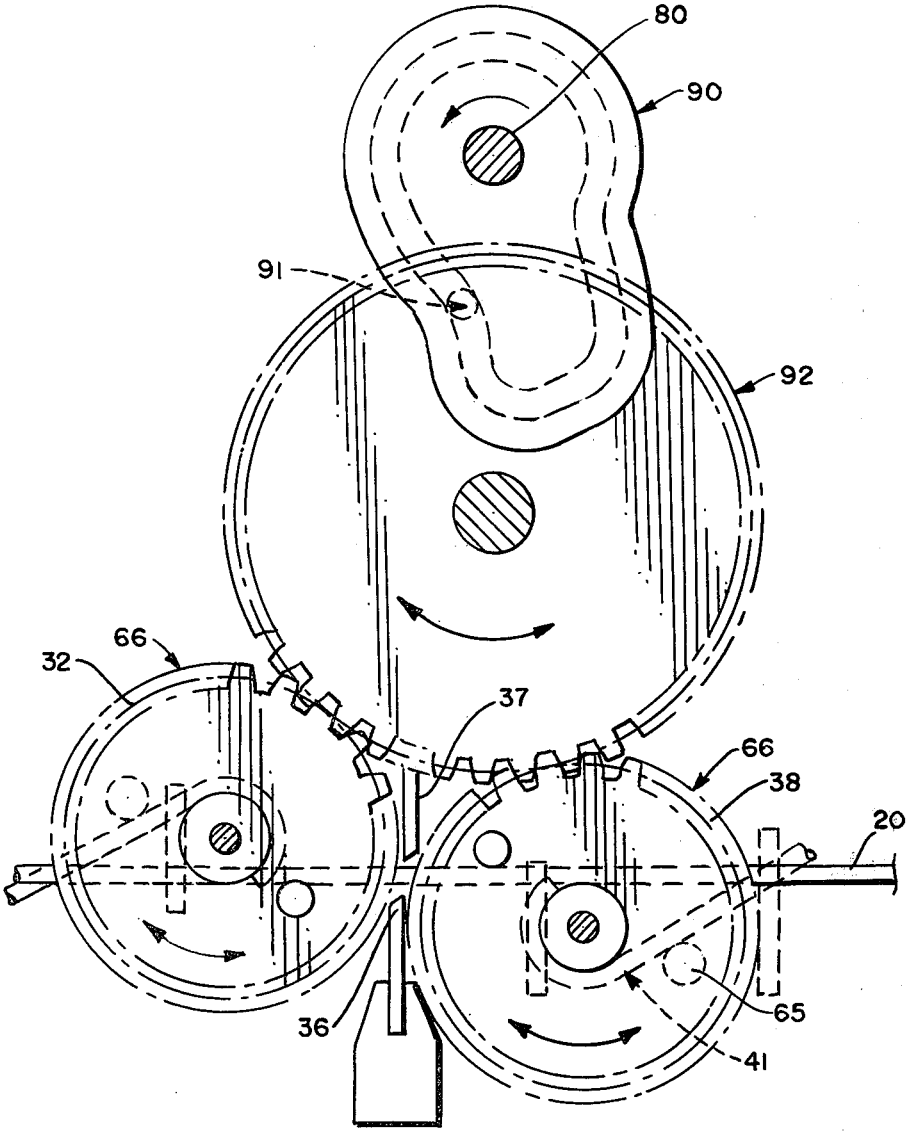
FIG. 15 is a cross-sectional view of the drive mechanism of the turntable assemble taken along line 15—15 of FIG. 14.

After the wire has been cut, the wire is positioned between the first anvil assembly 32, and the second anvil assembly 38, and is now ready for the subsequent operation of bending the looped end portions of the trailing end of the leading bale-tie wire and the leading end 40 of the trailing bale-tie wire, as will hereinafter be described. The first anvil assembly 32 (FIG. 5) is comprised of a shaft turntable 61, an anvil turntable assembly 63, and a mandrel turntable 64 rotatably secured to a turntable pin projection 65. A spur gear 66 is mounted to the turntable shaft 61 which is geared to and engageable with a second anvil assembly 38, which is comprised of identical components. The rotation of the first anvil assembly 32 is in the counter clockwise rotation of the second anvil assembly 38 is also in a counter clockwise direction such that after the cutter assembly 35 has severed the wire 20, the turntable pin projection 35 is sequentially rotated on the first anvil assembly 32 to form the looped end leading end 40 on the bale-tie wire 20, a position as shown in FIGS. 2 and 6. Simultaneously with the rotation of the first anvil assembly 32, the second anvil assembly 38 is geared for counter clockwise rotation (FIG. 15) by means wherein the turntable pin projection 65 rotates and forms the trailing looped end portion 41 of the wire 20, as shown in FIGS. 2 and 15. During the time of the engagement of the leading end 40 and the trailing end 41 about the first and second anvil assemblies 32 and 38 respectively, it is noted that the feed rolls 28 and 29 have continued to slip and that the oval cross-sectional bale-tie wire 20 has been permitted to pass around the accumulator assembly because of the constant feed of the round wire 10 through the ovalizing mill 16, a position shown as A in FIG. 2.

Figure 9:
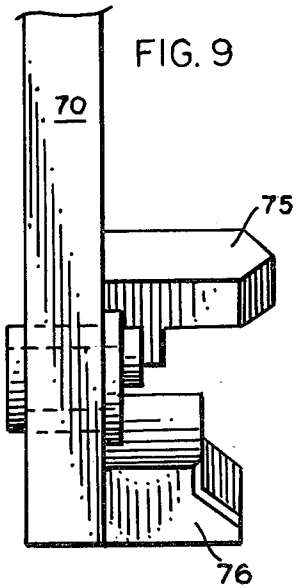
FIG. 9 is a side elevational view showing the plunger assembly for engaging the anvil turntable assembly for bending the looped end portion out of the plane of the body portion of the leading end of the trailing bale-tie wire in accordance with the present invention.
Figure 8:
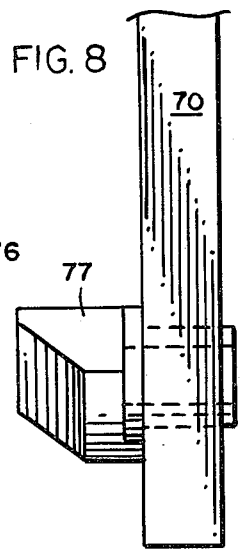
FIG. 8 is a side elevational view of the plunger assembly for engaging the anvil turntable assembly to bend the looped end portion of the trailing end of the leading bale-tie wire out of the plane of the body portion of the bale-tie wire in accordance with the present invention.
Figure 7:
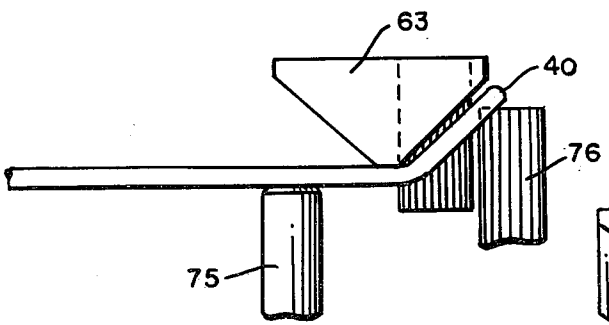
FIG. 7 is an enlarged top plan view showing the engagement of the plunger with the anvil turntable assembly to bend the leading end of the trailing bale-tie wire out of the plane of the body portion of the bale-tie wire in accordance with the present invention.

After the formation of the looped members of the leading end 40 and the trailing end 41 of the wire, a bar assembly on rocker arm 70 (FIG. 4) is actuated and movable from a first position 72 to a second position 74 by engagement of roller 71 with a cam element where it engages the looped end portions 40 and 41 of the bale-tie wire 10 while the end portions are positioned about the first and second anvil assemblies 32 and 38, respectively, as will hereinafter be described. As shown in FIGS. 4, 8, and 9, the bar assembly includes a plurality of plungers 75, 76, and 77 mounted thereof which are selectively engageable with the first and second anvil assemblies 32 and 38, as is shown in FIGS. 4 and 7 to selectively bend the looped end members 40 and 41 out of the plane of the body portion of the wire 20 to complete the process for manufacturing the oval cross-sectional bale-tie wire. After the bar assembly 70 has engaged the looped leading and trailing end members 40 and 41 to bend the ends out of the plane of the body portion of the wire 20, the bar assembly is returned from the second position 74 to the first position 72 and the trap door 45 is energized to permit the completed wire to drop downwardly out of the channel member 44 (FIG. 3). After the ejection of wire 20, the clutch assembly is released and the feed rolls 28 and 29 again feed the wire, as shown in FIG. 3, through the first and second anvil assemblies 32 and 38 until the leading looped end member 40 engages the limit stop switch 42 such that the process of making the bale-tie wire sequence of operations may be repeated. Preferably, the feed rolls 28 and 29 operate at a speed somewhat faster than the ovalizing mill 16 to permit the continuous uninterrupted flow of ovalized cross-sectional wire 20 through the ovalizing bale-tie assembly 22 to thereby maintain positive mechanical control of the wire 20 at all times through the completion of the bale-tie wire 20. By providing that the feed rolls 28 and 29 operate at a speed faster than the ovalizing mill 16, the apparatus reduces misfeeds, and substantially eliminates rejects due to rejected stumps of round bale-tie wire 10.

In a further embodiment of the present invention, a crimping assembly 78 may be used in conjunction with the channel member 44 such that during the operation of forming the looped ends 40 and 41 of the bale-tie wire, the crimper 78 may be energized to predeterminedly crimp the completed ovalized cross-sectional bale-tie wire 20 to aid and assist in properly orientating the bale-tie wire 20 about the corners of the baled material and to insure that the user of the wire 20 properly orientates the looped ends adjacent one another for proper engagement thereof.

As shown in FIG. 10, when the ovalizing rollers having a radius of 1 to 1½ times wire diameter and a depth of 0.020 to 0.040 inches are utilized as ovalizing mills 18 and 19 (as shown in FIG. 11), an increase in joint strength of about 5% is obtained over a standard round wire of similar cross-sectional area, chemistry and tensile strength. It is believed that this increased joint strength is attributable to the effects of draping the wire 20 over the wide surface of the looped portion 95 (FIG. 12) of the knot and bending the draped wire 96 along the major axis of the cross-section of the wire. The outer fibers 97 of the bale-tie wire 20 possess less concentrated tensile stresses than the outer fibers 98 of the round wire 10 (FIG. 13) thereby resulting in greater joint strength of the ovalized wire than obtainable with the standard round wire. Furthermore, FIG. 10 demonstrates that the increase in wire length due to ovalizing of a standard round wire 10 in relationship to the diameter on the B-axis of the ovalized wire may be as much as 5% without loss of knotting efficiency. Such an increase in knot strength and joint efficiency provides further increased product yield, results that have heretofore been unattainable with standard round bale-tie wire.

Figure 14:
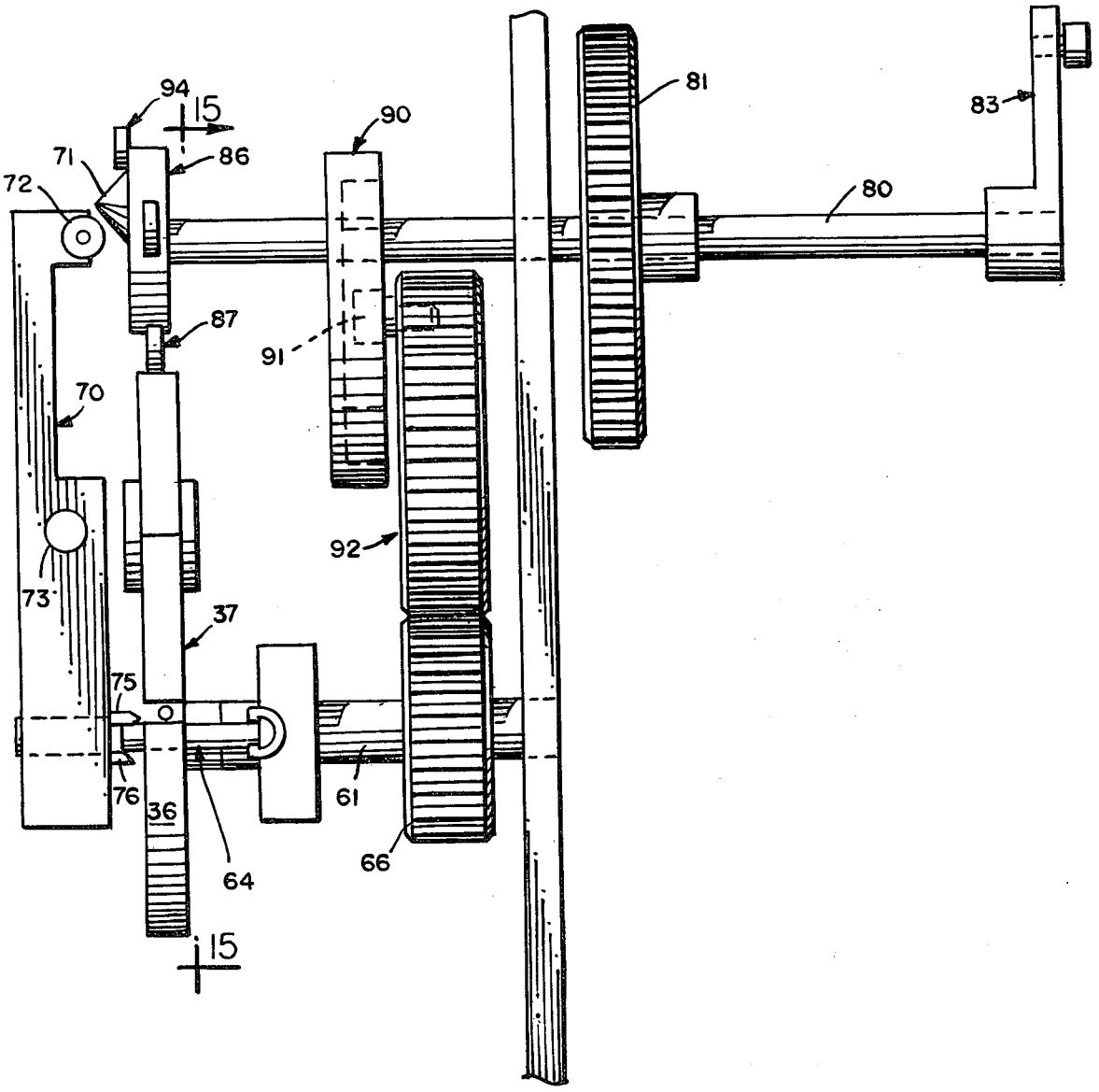
FIG. 14 is a perspective view of the drive mechanism and plunger assembly for bending the looped end portions out of the plane of the body portion of the bale-tie wire in accordance with the present invention.

FIGS. 14 and 15 show a mechanism structure for operating the feed rolls 28 and 29, cutter assemblies 36 and 37, the first and second anvil assemblies 32 and 38 and the bar assembly 70 to predeterminedly control the cutting and forming of the looped ends on the wire 20. A main drive shaft 80 is rotated by a sprocket gear 81 which is coupled to a drive motor (not shown), which is speed controlled by sensing the slack of the wire 20 in the accumulator 24, as is known in the art. The shaft 81 rotates a crank member 83 which is operatively connected by gear means through a clutch assembly (not shown) to feed rolls 28 and 29 to rotate the rolls to advance the wire 20 through the wire assembly 22, as will hereinafter be described.

The wire cutting mechanism is energized by a hub cam 86, which is mounted on and rotated by the main drive shaft 80, which includes a projection portion 87 thereon. The hub cam 86 rotates and projection 87 engages the upper movable cutter assembly 36 and moves the same downwardly to sever wire 20, as shown in FIG. 15, immediately after the drive rolls 28 and 29 have been disengaged by the clutch assemblies (not shown) through crank member 83. After the wire 20 has been severed, a loop forming cam 90, mounted upon the main driving shaft 80, engages a cam follower 91 to oscillate spur gear 92 which is meshed with spur gears 66 mounted to the turntable shaft 61 of each of the first and second anvil assemblies 32 and 38 respectively. As the cam 90 rotates, spur gear 92 oscillates back and forth, sequentially meshing with spur gears 66 to rotate the anvil assemblies 32 and 38 to form the looped ends, as shown in FIG. 15. After the looped end members are formed, a cam surface 71 mounted on the peripheral edge of hub cam 66 engages the pivotly mounted bar assembly plunger on rocker arm 70, which pivots about point 73, thereby engaging the roller 72 on arm 70 thereby forcing the plunger with elements 75 and 76 thereon inwardly to engage the looped end of the wire, as shown in FIGS. 7 and 14, to bend the loop ends out of the plane of the wire. Although, only elements 75 and 76 are shown engaging the looped ends of the wire, simultaneously, element 77 on the rocker arm 70 is engaging the other looped end to bend the same out of the plane of the wire. As shown in FIG. 14, for each revolution of shaft 80, the turntable assemblies 32 and 38 make one revolution, with the cam 71 engaging the rocker pivot arm 70 and roller 71 once for each revolution.

After the looped ends of the wire have been bent out of the plane of the wire, the rocker arm returns to its outward at rest position 72 and cam follower 94 on hub cam 66 engages means (not shown) to deflect the formed loops away from the madrel assemblies 32 and 38 to permit the wire 20 to be driven by drive rollers 28 and 29 onto the runout table to start the next cycle. Simultaneously, with the deflection of the formed loops, trap door 45 is engaged and opened to eject the completed wire and then closed to receive the wire for the next cycle of operation.

What has been described is a unique ovalized bale-tie wire wherein the ovalized wire possess a vertical cross-sectional reduction in diameter from conventional round bale-tie wires of between about 20–27 percent, as shown in FIG. 10.

I claim:

1. A bale-tie wire, including in combination:

an ovalized cross-sectional shaped body portion extending the length thereof, and ovalized cross-sectional shaped looped end portions formed at each end of said body portion and wherein each of said looped end portions are curved in opposite directions with respect to each other, transverse to the major axis of the oval cross-section of the wire, with each of said looped end portions including a leg portion extending inwardly from said looped end portions towards the middle of said body portion, with each of said looped end portions bent out of the plane of each respective loop in opposite directions thereof, said ovalized cross-sectional shaped body portion providing predeterminedly positioning of the bale-tie wire about a bale and permitting alignment and engagement of each of said looped end portions together to form a thief knot to secure the baled material, said thief knot after engagement of the ovalized cross-sectional shaped looped end portions possessing between 2%–5% increase in joint strength from a round bale-tie wire.

2. The bale-tie wire in accordance with claim 1 wherein the minor axis of said ovalized cross-sectional shaped body portion constitutes from about 20–27% reduction in the vertical cross-section diameter from a round bale-tie wire.

* * * * *